United States Patent [19]

Kecala

[11] Patent Number: 4,546,967

[45] Date of Patent: Oct. 15, 1985

[54] EXERCISE BENCH

[76] Inventor: Ihor G. Kecala, 3508 W. 17th Ave., Vancouver, British Columbia, Canada, V6S 1A1

[21] Appl. No.: 460,934

[22] Filed: Jan. 25, 1983

[51] Int. Cl.[4] ..... A63B 23/00

[52] U.S. Cl. ..... 272/93; 272/DIG. 4; 272/144; 128/74

[58] Field of Search ..... 272/93, 123, 118, 117, 272/134, 144, 145; 128/74

[56] References Cited

U.S. PATENT DOCUMENTS

| | | | |
|---|---|---|---|
| 1,158,779 | 11/1915 | Bolger | 272/145 X |
| 2,733,922 | 2/1956 | Diego . | |
| 2,831,687 | 4/1958 | Hunter . | |
| 3,120,954 | 2/1964 | Apostol . | |
| 4,098,502 | 7/1978 | Faust | 272/117 X |
| 4,200,297 | 4/1980 | Lambert | 272/118 |
| 4,240,626 | 12/1980 | Lambert | 272/118 |
| 4,256,302 | 3/1981 | Keiser et al. | 272/118 |
| 4,353,547 | 10/1982 | Jenkinson | 272/134 X |

FOREIGN PATENT DOCUMENTS 0024019 3/1907 Sweden .

*Primary Examiner*—Richard J. Apley
*Assistant Examiner*—William R. Browne
*Attorney, Agent, or Firm*—Carver & Co.

[57] ABSTRACT

An extendable bench having a long front seat portion hinged to a short rear seat portion. Extendable support supports the bench at the hinge connection and at the front seat portion. Front and rear seat portions are independently tiltable. An arm with rollers engages arms and legs of a user and can be connected to the bench at various locations. The bench is extremely versatile and compact, and can be adjusted to any of its various exercise stations quickly, easily and without the use of tools.

16 Claims, 20 Drawing Figures

EXERCISE BENCH

BACKGROUND OF THE INVENTION

1. Field of the Invention

The invention relates to an exercise bench which can be easily adjusted to many different positions to enable the user to perform a great variety of exercises.

2. Prior Art

Modern body or muscle building is usually done at fitness centers on different types of benches or machines on which certain exercises can be performed for building or strengthening different muscles of the human body.

There have been many attempts to combine several benches or machines into one combination unit, on which most of the important exercises can be perfomed. Such multi-purpose benches are especially suitable for home use, where space is limited and the price of separate units is excessive.

A multi-purpose bench of this kind is disclosed in U.S. Pat. No. 4,098,502 to Faust. The known bench can be converted to any one of eight different uses. However the tilting mechanism of the bench portions and the construction of the roller and weight plate carrying mechanism employed limits the number of exercises that can be performed. This bench furthermore still requires a considerable amount of floor space.

SUMMARY OF THE INVENTION

The present invention reduces difficulties and disadvantages of the prior art. An exercise bench according to the invention comprises a horizontal ground engaging base having front and rear ends and a bench having a comparatively long front seat portion and a comparatively short rear seat portion, each seat portion having front and rear ends. Hinge means connect the rear end of the front seat portion to the front end of the rear seat portion. First extendable support means are rigidly connected to the base and support the bench at the hinge means. Second extendable support means are pivotally connected adjacent the front end of the base and engage the front seat portion for adjustable tilting the front seat portion from a horizontal position to an upwardly or downwardly inclined position. Tilting means are provided for adjustably tilting the rear seat portion from a horizontal position to an upwardly or downwardly inclined position. An elongated arm has a cross member connected at one end, which cross member carries on its free ends one roller each for engaging body extremities during certain exercises, and the bench system is adapted to receive the elongated arm at selectable locations.

A detailed disclosure following, related to drawings, describes a preferred embodiment of the invention which however is capable of expression in structure other than that particularly described and illustrated.

DETAILED DISCLOSURE

Figure 1:
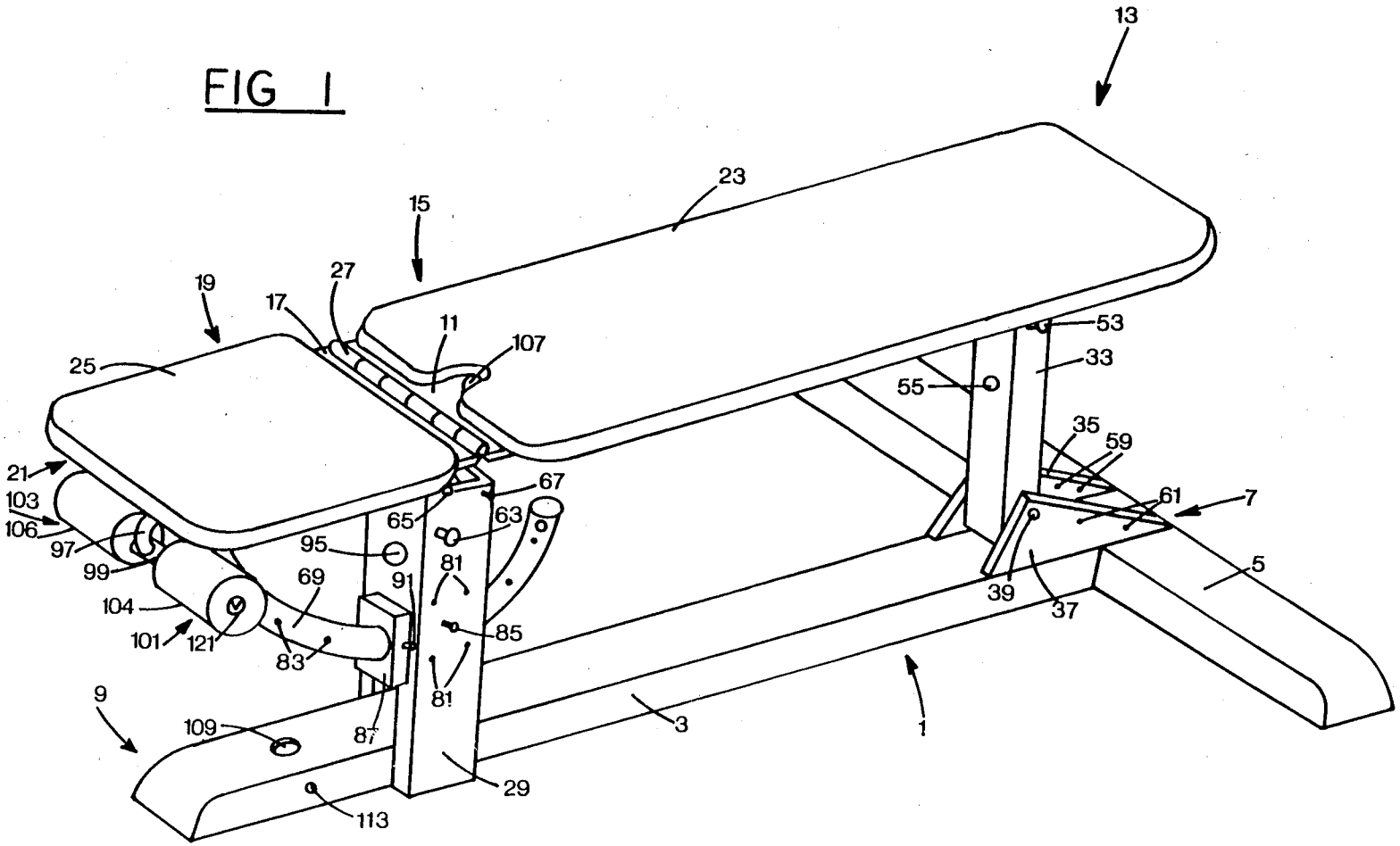
FIG. 1 is a perspective view of an exercise bench according to the invention.
Figure 2:
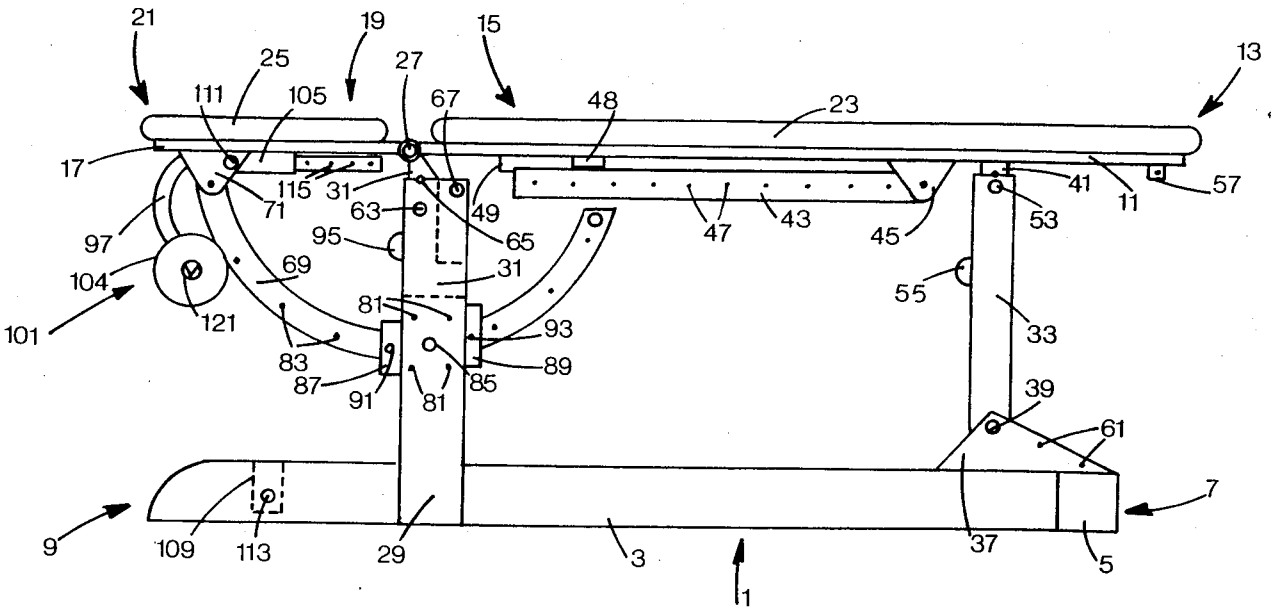
FIG. 2 is a side elevation of the bench with the seat portions in horizontal position.

Referring mainly to FIGS. 1 and 2, the exercise bench comprises a ground engaging base 1, preferably made of steel channel sections connected by welding. The base has a longitudinal member 3 and a cross member 5. The base has a front end 7 and a rear end 9. The exercise bench further comprises a comparatively long front seat portion 11 having a front end 13 and a rear end 15, and a relatively short rear seat portion 17 having a front end 19 and a rear end 21. The seat portions are covered by a front cushion 23 and a rear cushion 25. The rear end of the front seat portion is connected to the front end of the rear seat portion by a hinge 27.

First extendable support means are provided for supporting the bench at the hinge 27. The means comprise a support column 29 rigidly connected to the longitudinal member 3 of the base 1, and an insert member 31 (shown in FIG. 2 partly in broken lines) which can be moved vertically up or down inside the support column 29 under certain circumstances as will be explained below.

Second extendable support means are provided for adjustably tilting the front seat portion. The means comprise a support column 33 pivotally connected to brackets 35 and 37 by a bolt 39. The brackets 35 and 37 are rigidly connected to the base 1.

When the front seat portion 11 of the bench is in the horizontal position, the support column 33 engages a spigot 41 for arresting the support column in position. An insert member 43 is pivotally connected to the front seat portion 11 by means of a bracket 45. The insert member 43 is folded alongside the front seat portion 11 in its rest position and is held against a rubber bumper 48 by a spring clip 49.

Figure 3:
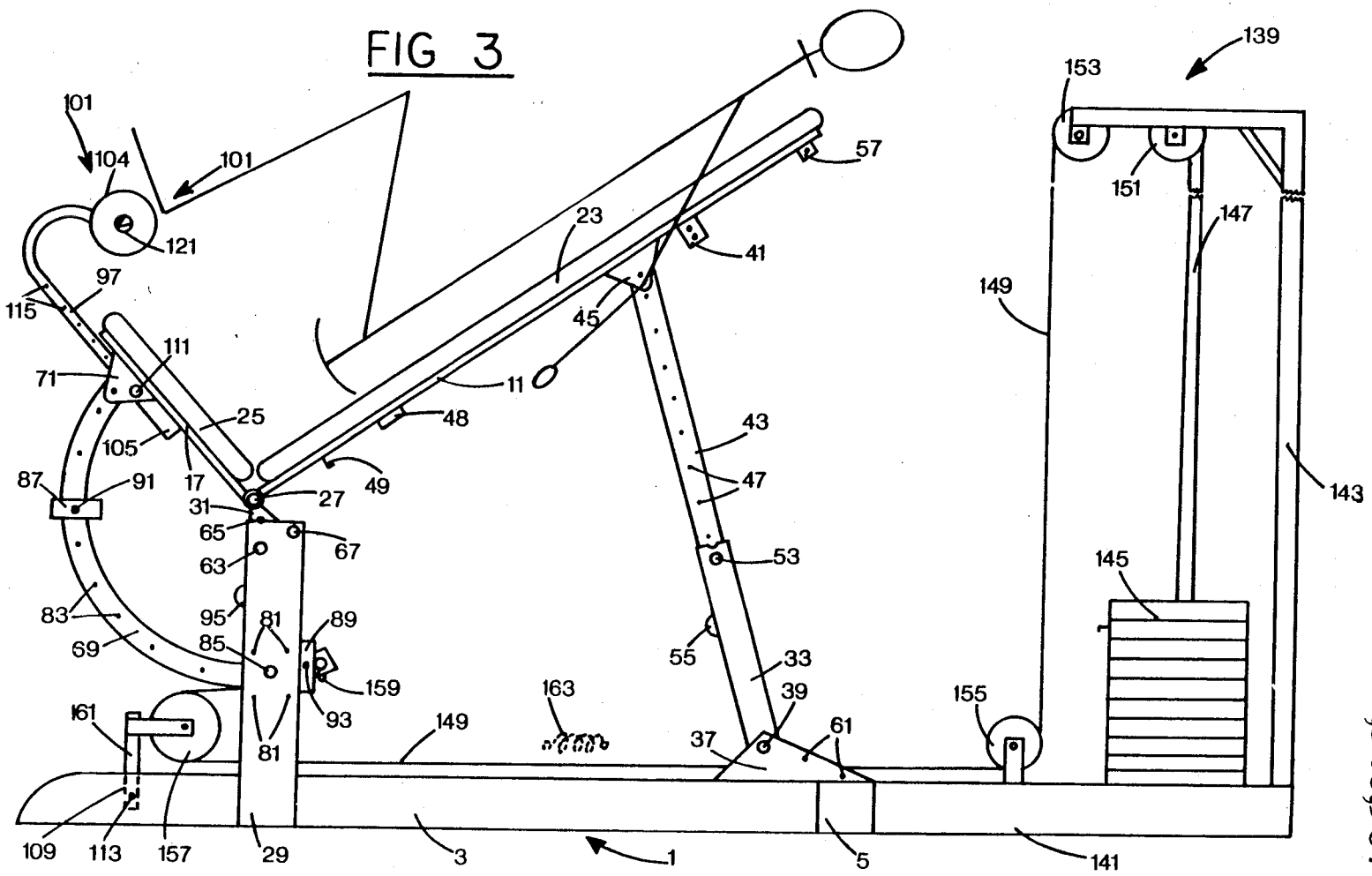
FIG. 3 is a side elevation of the bench with the seat portions in inclined position and a simplified pulley and weight arrangement connected, shown fragmented with reduced height.
Figure 6:
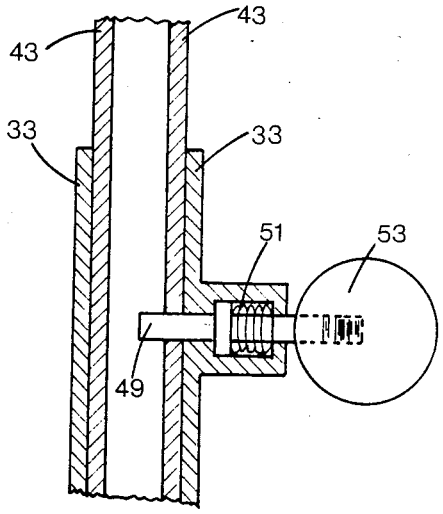
FIG. 6 shows a locking means on the extendable support means, fragmented and partly in cross section.

If it is desired to tilt the front seat portion 11 to an upwardly inclined position as shown in FIG. 3, the insert member 43 is inserted into the support column 33 with its free end. It can be moved telescopically up and down inside the support column 33 and arrested in any desired position by locking means which engage holes, severally indicated at 47, in the insert member 43. The locking means is preferably a pin 49 loaded by a spring 51 and operated by a handle 53 (FIG. 6). The weight stack arrangement 139 shown in FIG. 3 will be described later.

Figure 4:
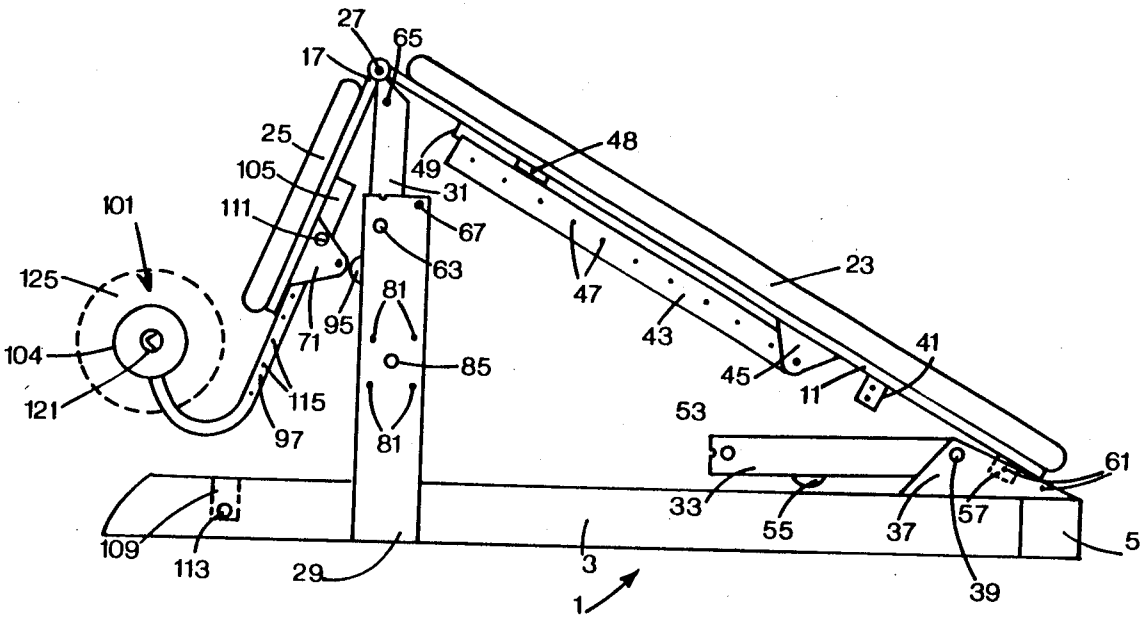
FIG. 4 is a side elevation of the bench with the seat portions in a different inclined position.
Figure 5:
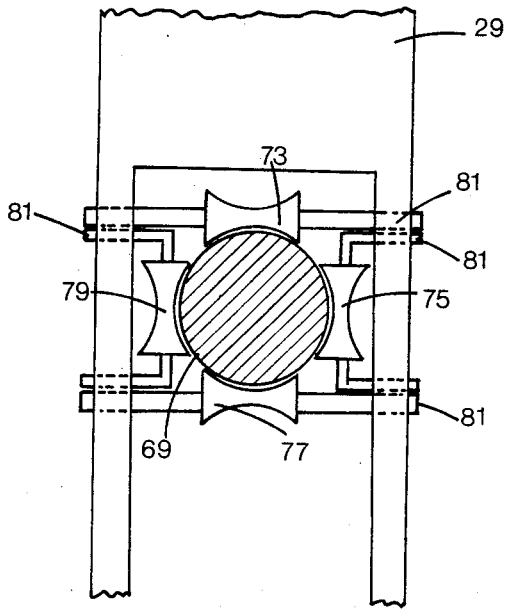
FIG. 5 is an elevation of a contoured guide roller arrangement with the rocker arm shown in cross section.

If it is desired to tilt the front seat portion 11 to an inclined downwards position, the insert member 43 is folded to its rest position and the support column 33 is folded alongside the base 1 and rests on the rubber bumper 55. The front end 13 of the front seat portion 11 is held in position by means of a spigot 57 between the brackets 35 and 37 and a pin (not shown) engaging the holes 59 and 61 in the brackets (FIG. 4). The upper holes are used when the insert member 31 is extended, as in FIG. 4, and the lower holes are used when the insert member 31 is in the lowest position. The insert member 31 can be arrested in its extended position by a pin engaging a hole (not shown) operated by a handle 63 in a similar locking arrangement as that shown in FIG. 6. A limit pin 65 stabilizes the insert member 31 in its low position on the support column 29.

Tilting means in the form of an arc-shaped, tubular rocker arm 69 support the rear seat portion 17. The rocker arm 69 is connected with one end to the rear seat portion 17 by means of a bracket 71 and slidably supported by contoured rollers 73, 75, 77 and 79 within the support column 29. The contoured rollers are connected to the support column by axles, severally indicated at 81. The rocker arm can be locked in a desired position by locking means (not shown) such as a pin cooperating with holes, severally indicated at 83, the locking means being operated by a handle 85. Stoppers 87, 89 with pins 91 and 93 cooperating with the holes 83 can be used to limit the movement of the rocker arm 69 over a certain range of its arc and with it the tilting range of the rear seat position 17 (FIG. 3).

If the rocker arm 69 is not required for certain exercises, it can be disconnected from the bench and set aside. The lowest tilting position of the rear seat portion 17 is then limited by the rubber bumper 95 (FIG. 4).

In many bench exercises, rollers mounted on arms are used to constrain or support the legs or arms of the user. For this purpose an elongated arm 97 is provided, which has a cross member 99 connected to it. This cross member carries two rollers 101 and 103 having outside paddings 104 and 106. The straight portion of the elongated arm 97 is receivable in sockets at various locations of the bench, such as the socket 105 below the rear seat portion 17, the socket 107 at the rear end of the front seat portion, and the socket 109 at the rear end 9 of the base 1. The elongated arm can be secured by pins 67, 111 and 113 cooperating with holes in the elongated arm, severally indicated at 115. The arm with the roller can assume many different positions, horizontal or vertical with the rollers pointing upwards or downwards, to the front, or to the rear. This contributes to the versatility of exercises that can be performed on the bench.

Figure 7:
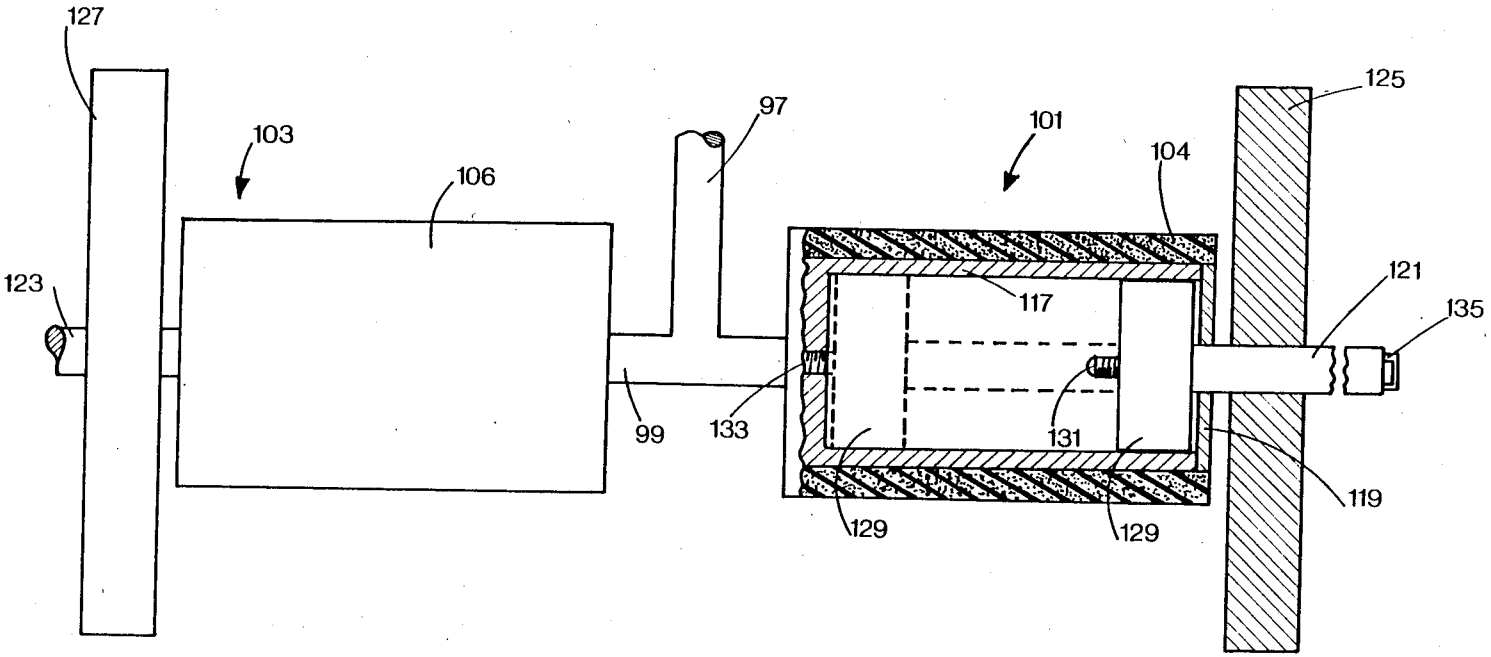
FIG. 7 is a side elevation, partly fragmented and in cross section, of an elongated arm and roller arrangement showing the extension holders for the weight plates.

The elongated arm with the rollers is adapted to receive weight plates when used in conjunction with the tiltable rear seat portion, e.g. in a bench position according to FIG. 4. These weight plates act as resistance means for providing resistance to the tilting movement of the rear seat portion. This adaptation will now be described in more detail in connection with FIG. 7. The roller 101 is partly fragmented and in cross section to show the inner parts. The roller 103 is identical to the roller 101. The cross member 99 is connected to one end of a cylindrical housing 117; the other end is closed by an end plate 119. The housing is surrounded by padding 104 or 106 respectively. Extension holders 121 and 123 are provided to receive weight plates 125 and 127 for certain exercises. Each extension holder has a plunger at one end, one plunger being designated 129. If no weight plates are used, each extension holder can be pushed into its retracted rest position inside the housing as shown in broken lines. One end 131 of the extension holder protruding from the plunger is threaded. This threaded end can be screwed into a threaded bore 133 by turning the extension holder by means of a clip 135. In this retracted position the extension holders stay fixed inside the rollers and are out of the way thus not obstructing the natural and proper performance of certain exercises and thus preventing injuries to the user. If weight plates are to be used, the extension holders are unscrewed and then pulled out of the rollers until the plungers contacting the end plates prevent further outwards movement. The weight plates can then be loaded onto the extension holders for providing selectable resistance to the tilting movement of the rear seat portion 17. The weights are securely held in place on the extension holders via standard dumbbell collars (not shown).

FIG. 3 shows a weight stack arrangement 139 acting as resistance means and added to the bench as an accessory. It comprises a base 141 connected to the base 1 of the bench, a gallows 143, a weight stack 145, and a guide column 147. A cable 149 is connected with one end to the weight stack and with its other end to the rocker arm at 159. A groove (not shown) in the underside of the rocker arm accomodates the cable and prevents it from slipping off the rocker arm. Pulleys 151, 153, 155 and 157 change the direction of the cable. The anchor bar 161 of the pulley 157 is inserted into the socket 109 at the rear end of the longitudinal member 3 of the base 1 of the bench. This arrangement can be used as a leg press. The user lies on the upwardly inclined front seat portion 11 with his legs angled and pulled up to his body and his feet resting on the rollers 101 and 103. He then extends his legs, tilting the rear seat portion downwards against the resistance of the cable-connected weight stack, which is lifted upwards. Thereafter the legs are returned to the starting position.

Out of the many exercises that can be performed on the bench, the more important ones will now be described by way of example in connection with the drawings. The arrows indicate the movement of the body parts concerned from the starting position.

In FIGS. 1 and 2 the bench is set up as a flat bench with both seat portions arrested in horizontal position and the rollers out of the way underneath the rear seat portion. The user lies on his back and lifts bar bells, an exercise known as bench press. Many exercises can be performed on a flat bench, and the user can sit with his legs straddled.

Figure 8:
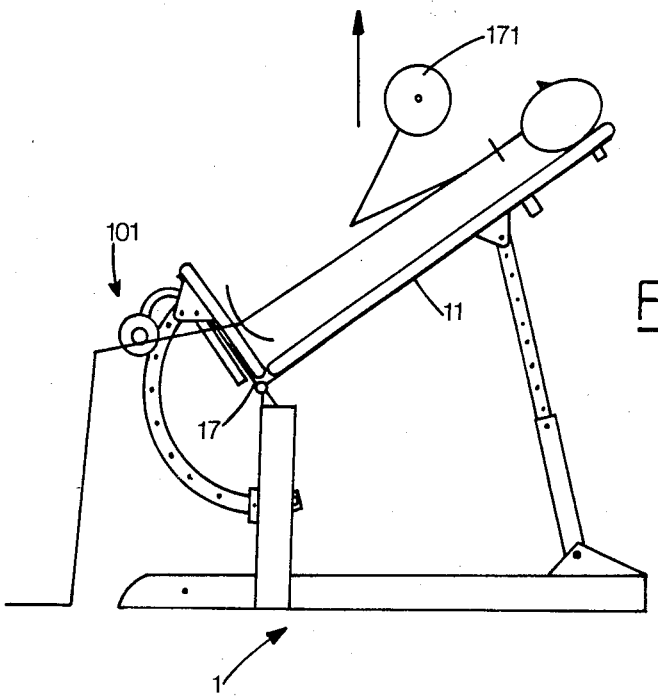
FIGS. 8–19 show in simplified form the bench in various positions for performing certain exercises.

In FIG. 8 the bench is set up as a dually adjustable seated incline bench. The front seat portion 11 is usually adjusted at an angle of approximately 35° to 45° to the horizontal, and the rear seat portion 17 is usually at an angle of 90° with respect to the front seat portion. The user lies on his back and the angled rear seat portion prevents him from sliding off the bench. The primary use is as an inclined bench press, lifting barbells 171. The rollers 101 and 103 are in rest position.

Figure 9:
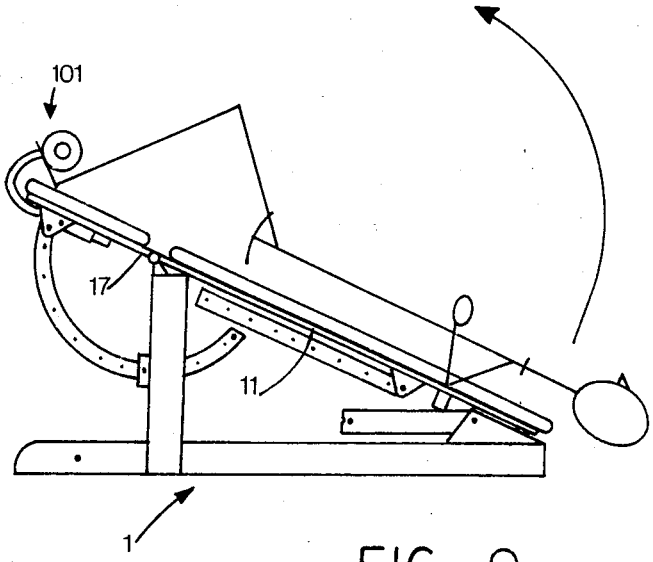

In FIG. 9 the bench is set up as an inclined sit-up board. The front seat portion 11 is folded down to its maximum downward inclination and the rear seat portion 17 is tilted upwards to form an extension of the front seat portion. The rollers 101 and 103 are in active position above the rear seat portion. The user lies on his back with his legs angled upwards and his feet stuck below the rollers. He lifts his upper body and returns to the rest position. The inclined bench creates greater resistance when doing sit-ups than a horizontal bench.

Figure 10:
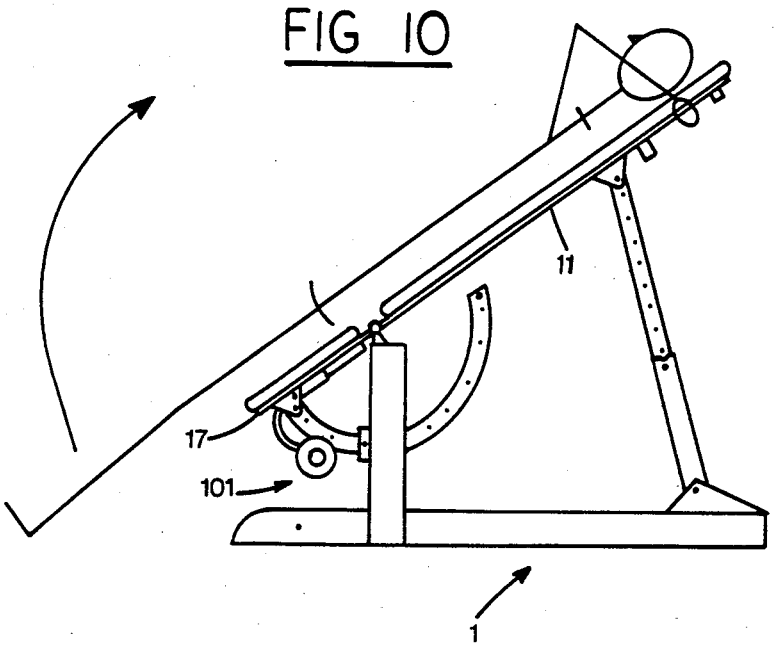

In FIG. 10 the bench is set up as an inclined leg raise board. The front seat portion 11 is upwardly inclined and the rear seat portion 17 is downwardly inclined to form an extension to the front seat portion. The rollers 101 and 103 are in their rest position. The user lies on his back, raising and lowering his legs. The inclination of the bench creates greater resistance for doing leg raises.

Figure 11:
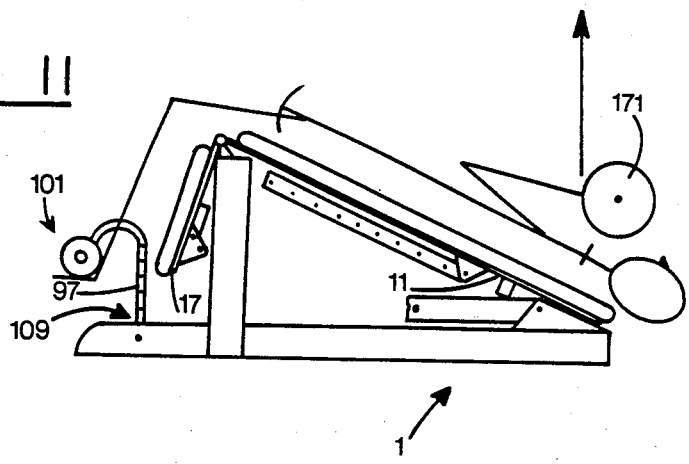

In FIG. 11 the bench is set up as a decline bench. The front seat and rear seat portions 11 and 17 are lowered to their maximum downward inclination with the rocker arm removed from the rear seat portion. The elongated arm 97 is vertically inserted into the socket 109 at the rear end of the base of the bench. The user lies on his back with his feet hooked under the rollers 101 and 103. He lifts barbells 171, using the bench as a decline bench press to stress lower chest, shoulders and triceps.

Figure 12:
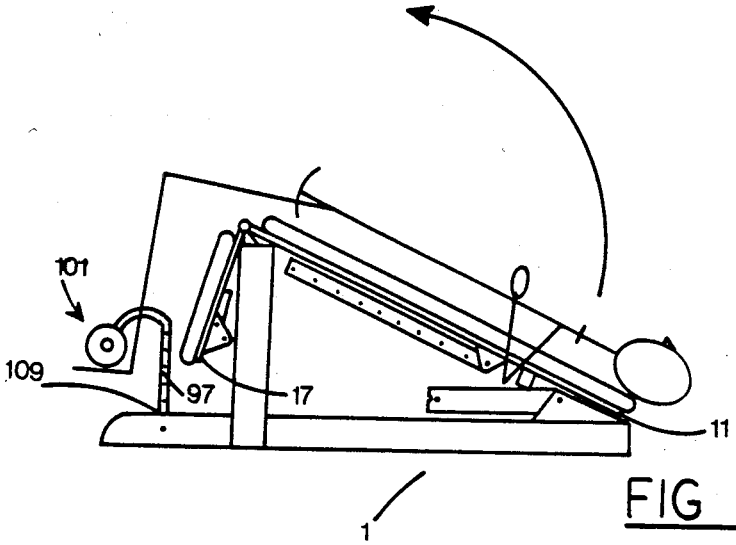

In FIG. 12 the bench is set up as in FIG. 11 and used as a decline Roman chair for doing sit-ups. This creates great isolation and resistance to abdominal muscles.

Figure 13:
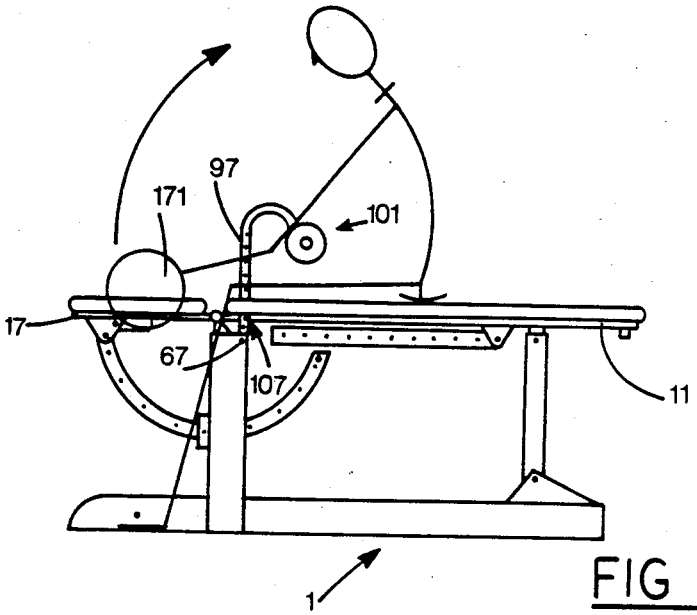

In FIG. 13 the bench is set up as a preacher or Scott curl bench. The front and rear seat portions 11 and 17 are fixed in horizontal position and the elongated arm 97 is vertically inserted into the socket at the rear of the front seat portion 11. The user sits on the front seat portion with his legs straddling. His back is curved or tilted so that his upper arms are supported near the elbows by the rollers. He lifts barbells 171 in what can be designated as a preacher biceps curl. This stimulates the biceps from origin to insertion. The horizontal position of the rear seat portion 17 serves as a rest support for barbell 171 before and after the preacher biceps curl exercise. The tubular dimensions of the rollers 101 and 103 enable the user to place his upper arm at various desired angles to the rollers and thereby to provide greater stimulation to various portions of his biceps muscles. The elongated arm 97 can be telescopically raised and lowered in height via selected holes 115 cooperating with pin 67 to accommodate persons of different bodily dimensions.

The bench position shown in FIG. 13 also serves as a triceps extension bench. The user lies down on his back on the front seat portion with his head under or adjacent the rollers. The upper arms (in one angular choice of the exercise) are positioned in an approximately vertical position and resting against rollers 101 and 103. A barbell is then raised and lowered by extending the forearms thus exercising the triceps muscles in an exercise known as the lying french press. The tubular dimensions of the rollers 101 and 103 enable the user to place his upper arms at various desired angles to the rollers and thus provide greater stimulation to various portions of his triceps muscles. The horizontal position of the rear seat portion 17 serves as a rest support for the barbell before and after the aforementioned exercise.

Figure 14:
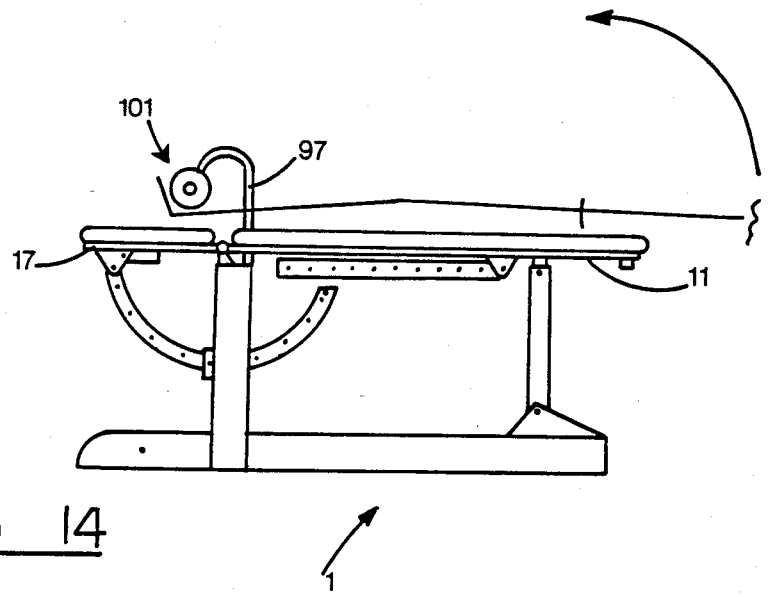

In FIG. 14 the bench is set up as in FIG. 13, however the rollers 101 and 103 point towards the rear end of the bench. The user has his legs straight and his feet hooked under the rollers. His upper body is not supported on the bench. He does Roman chair sit-ups, which is a very intense abdominal specializing exercise.

This bench position also serves as a wrist curl bench. The user places his forearms on rollers 101 and 103 and raises and lowers barbells with the wrist, thus exercising the muscles of the forearm which operate the wrist. Wrist curls can be done with palms facing up and also facing down. The tubular dimensions of the rollers 101 and 103 enable the user to place his forearms at various desired angles to the rollers thereby stimulating various portions of his forearm muscles. The horizontal position of the rear seat portion 17 serves as a rest support for the barbells before and after the wrist curl exercise.

Figure 15:
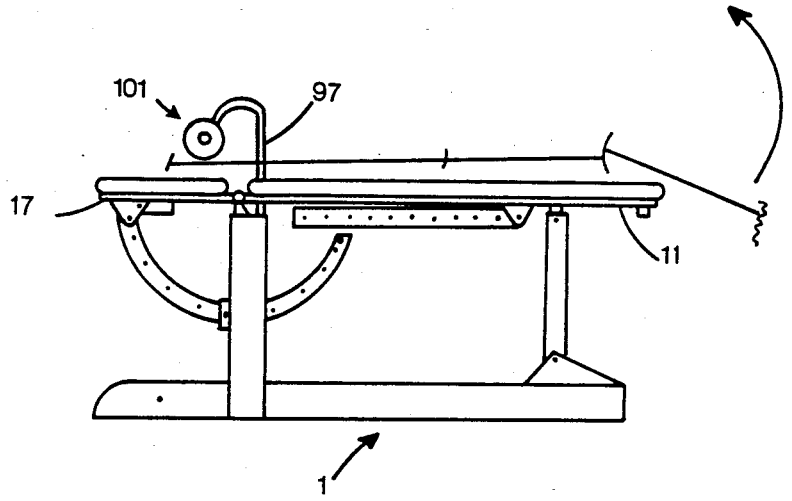

In FIG. 15 the bench is set up as in FIG. 14. The user is lying sideways with his feet under the rollers. His upper body is not supported by the bench. The bench is used as an oblique isolator, and the user works his side muscles (obliques).

Figure 16:
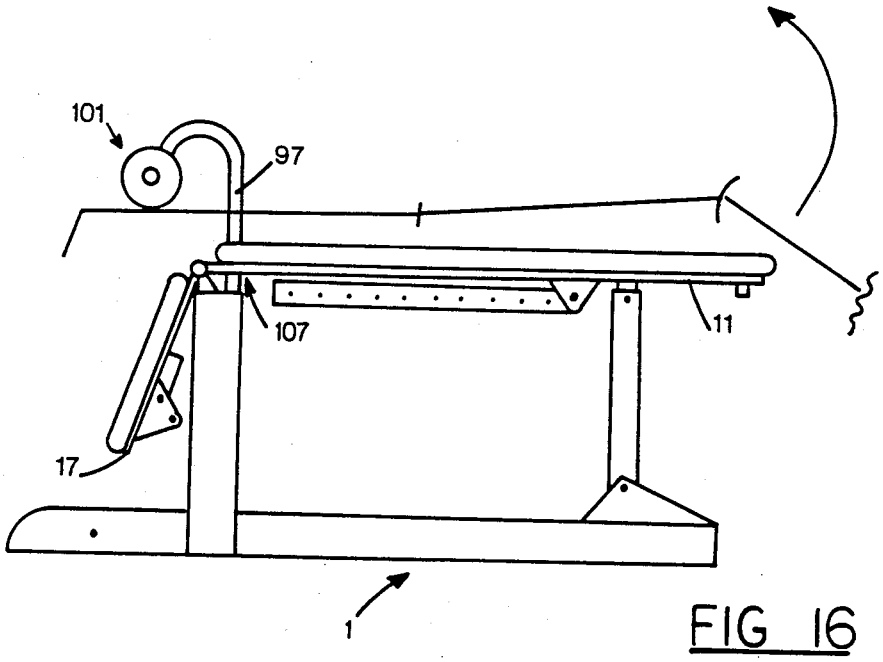

In FIG. 16 the bench is set up for hyper-extension. The front seat portion 11 is fixed horizontally and the rear seat portion 17 is tilted downwards with the rocker arm removed. The elongated arm 97 is vertically inserted into the socket 107 at the rear end of the front seat portion and secured with pin 67 in one of the holes 115 with the rollers 101 and 103 pointing to the rear of the bench. The user lies on his stomach with his lower legs held under the rollers. The upper body is not supported by the bench and is raised and lowered for working the muscles of the lower back in a horizontal variation of a bend-over.

Figure 17:
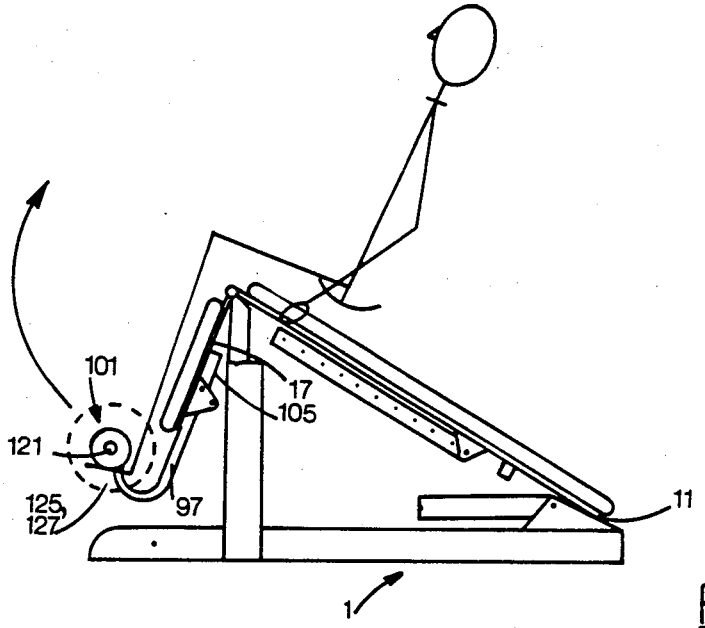

In FIG. 17 the bench is set up as a leg extension machine. The front seat portion 11 is lowered to its maximum downward inclination, and the rear seat portion 17 is tilted to its lowest setting with the rocker arm removed. The elongated arm 97 is inserted into the socket 105 under the rear seat portion and the rollers 101 and 103 point upwards. The extension holders 121 and 123 are extending from the rollers and carry weight plates 125 and 127 shown in broken lines. The lower legs contact the rollers. The legs are raised against the resistance of the weights and lowered to the rest position for working the lower portions of the thighs (quadriceps) close to the knees.

Figure 18:
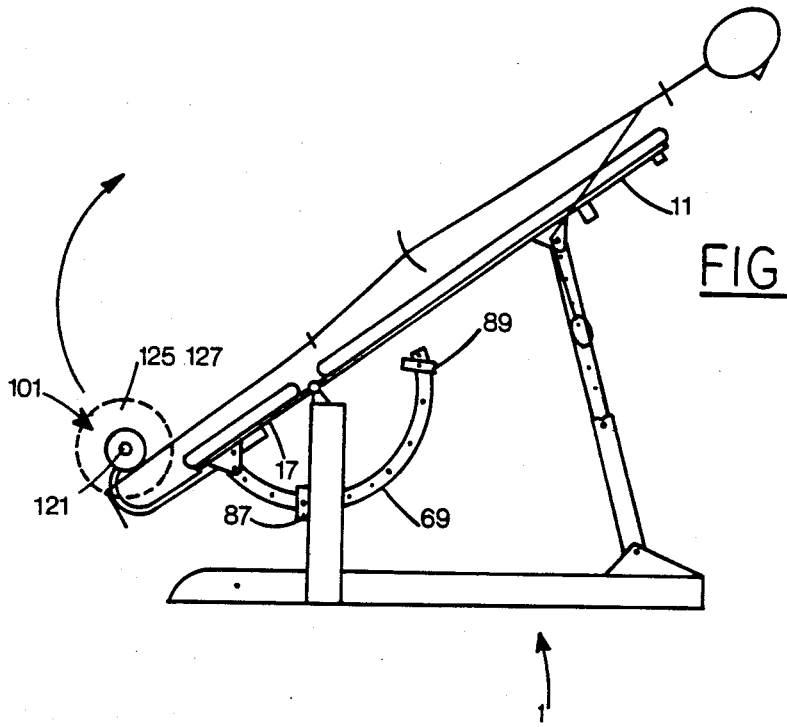

In FIG. 18 the bench is set up as a leg curl machine. The front seat portion 11 is upwardly inclined, and the rear seat portion 17 is downwardly inclined to form an extension of the front seat portion in the starting position. A stopper 87 on the rocker arm 69 prevents further movement downwards. The user lies on his stomach with his lower legs engaging the rollers. The extension holders 121 and 123 are in their extended position and carry weight plates 125 and 127. The legs are angled upwards against the resistance of the weights by tilting the rear seat portion upwards. The range of the tilting movement is limited by a second stopper 89 on the end of the rocker arm 69. This exercise works the leg biceps.

Figure 19:
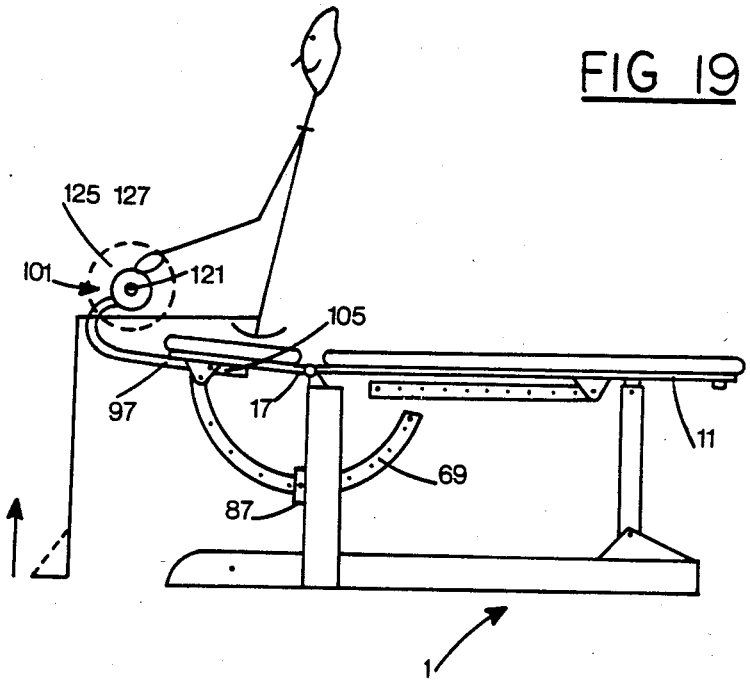

In FIG. 19 the bench is set up as a seated calf machine. The front seat portion 11 is fixed in a horizontal position, and the rear seat portion 17 is prevented from tilting lower than a horizontal position by the stopper 87 on the rocker arm 69, but can tilt upwards. The elongated arm 97 is inserted into the socket 105 on the rear seat portion with the rollers 101 and 103 pointing upwards. The extension holders 121 and 123 carry weight plates 125 and 127 shown in broken lines. The user sits on the rear seat portion 17 with his feet flat on the floor. He now raises his heels (indicated in broken lines) from the floor thereby lifting the weight plates upwards with his upper legs under the rollers. In a way he lifts his own weight by slightly tilting the rear seat portion upwards. A fit man could easily use up to 100 to 150 kg of resistance in this exercise. This would mean piling up a lot of weight plates. Due to the unique feature of the bench according to the invention, namely that the seat is on the lever itself, less weight is required on the extension holders, because the user uses his own body weight from the knees upwards. This exercise develops the calf muscles.

Figure 20:
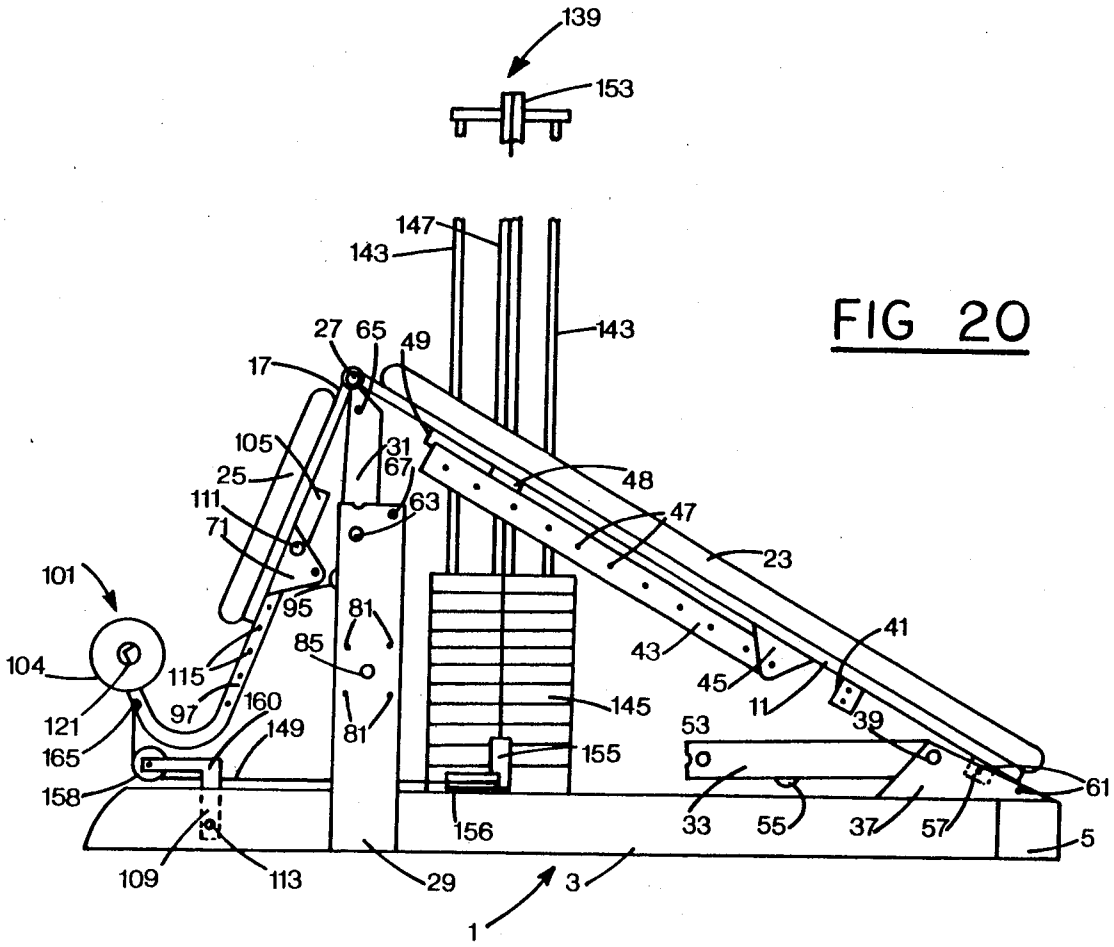
FIG. 20 is a side elevation of the bench with the seat portions in inclined position and a simplified pulley and weight arrangement connected, shown fragmented with reduced height.

FIG. 20 shows the exercise bench in the same position as in FIG. 4, however instead of the weight plates 125, 127 a weight stack arrangement 139 similar to that described in conjunction with FIG. 3 but connected sidewise to the bench is acting as resistance means for providing resistance to the tilting movement of the rear seat portion 17. A pulley 156 changes the direction of the cable 149, and a pulley 158 supported by an angled arm 160 secured in the socket 109 positions the end of the cable 149 below the elongated arm 97 where it is connected to that arm at a point 165 adjacent the rollers 101, 103.

When the exercise bench is used in this position for the leg extension exercise as decribed in conjunction with FIG. 17, the weight moves upwards, when the rear seat portion tilts upwards. The cable 149 adjoins the curved portion of the elongated arm 97 in a groove located on the underside of the arm (not shown) during the tilting movement. When the rear seat portion tilts progressively from the starting position to a position where the rear seat portion is horizontal, the resistance created by the weight increases with increasing leverage. The resistance would decrease again, if the rear seat portion is tilted further upwards past the horizontal position.

Other exercises can be performed with the weight stack arrangement connected as described above, such as the leg curl exercise described in conjunction with FIG. 18 and the seated calf exercise described in conjunction with FIG. 19. The variation of the resistance created by the weight stack during the tilting movement obviously depends on the tilting angle of the rear seat portion, the extension of the elongated arm and the contour of its hook, and the dimensions of the arm 160. These variables can be suitable selected as desired.

ALTERNATIVES

In the foregoing weights have been described as resistance means for providing resistance to the tilting movement of the rear seat portion. It should be clearly understood that other means of resistance can be used instead of weights, like resilient tension links, e.g. in the form of rubber strings or springs.

In FIG. 3, e.g. the weight stack arrangement could be dispensed with by fastening the cable 149 at the front end of the base and to insert a spring 163 (shown in broken lines) into the horizontal part of the cable. Springs of different resistance values could be inserted to decrease or increase the leg pressure necessary for tilting the rear seat portion. The cable 149 could also be replaced by rubber string connected with one end to the rocker arm 69 as shown and with its other end to the front end of the base. Rubber strings of different resistance values can be selected for the purpose described above.

The use of resilient tension links is of course not limited to the arrangement shown in FIG. 3. It is obvious how such links can be connected to replace the weights mentioned in the description.

I claim:

1. An exercise bench comprising:

(a) a horizontal ground engaging base having front and rear ends, (b) a bench having a comparitively long front seat portion and a comparitively short rear seat portion, each seat portion having front and rear ends, (c) hinge means connecting the rear end of the front seat portion to the front end of the rear seat portion, (d) first extendable support means rigidly connected to the base and supporting the bench at the hinge means, (e) second extendible support means pivotally connected adjacent the front end of the base and engaging the front seat portion for adjustably tilting the front seat portion from a horizontal position to an upwardly or downwardly inclined position, (f) tilting means for adjustably tilting the rear seat portion from a horizontal position to an upwardly or downwardly inclined position, (g) an elongated arm having a cross member connected at one end, which cross member carries on its free ends one roller each for engaging body extremities during certain exercises, and (h) a plurality of means at different locations on the exercise bench for selectively receiving the elongated arm at one of said locations.

2. An exercise bench as claimed in claim 1, wherein resistance means are connectable to the rear seat portion for providing resistance to the tilting movement thereof.

3. An exercise bench as claimed in claim 2, wherein the resistance means is a weight.

4. An exercise bench as claimed in claim 1, wherein the elongated arm has a straight portion at one end and a hook-shaped portion at the other end and has the cross member carrying the rollers connected at the hook-shaped end, the means for selectively receiving the elongated arm comprising a plurality of sockets on the bench.

5. An exercise bench as claimed in claim 4, wherein one of said sockets is located underneath the rear seat portion for horizontally receiving the straight portion of the elongated arm.

6. An exercise bench as claimed in claim 4, wherein one said socket is located adjacent the rear end of the base for vertically receiving the straight portion of the elongated arm.

7. An exercise bench as claimed in claim 4, wherein a one of said sockets is located adjacent the rear end of the front seat portion for vertically receiving the straight portion of the elongated arm.

8. An exercise bench as claimed in claim 4, wherein extension holders are provided on the rollers for receiving weight plates during certain exercises, which holders are adapted to move from a retracted rest position inside the rollers to an extended operative position outside the rollers.

9. An exercise bench as claimed in claim 8, wherein each extension holder comprises a plunger slidably received in a tube inside a roller, which plunger is connected to one end of a bar adapted to receive weight plates.

10. An exercise bench as claimed in claim 1, further comprising a first insert member on the bench at the hinge means and a second insert member on the front seat portion of the bench, the first and second extendible support means each having a support column telescopically cooperating with the first and second insert members respectively, and locking means for arresting each insert member at a desired position of extension.

11. An exercise bench as claimed in claim 10, wherein the second insert member is connected to the front seat portion by pivot means for folding the insert member from an operative position engaging the support column to a rest position alongside the front seat portion.

12. An exercise bench as claimed in claim 11, wherein the support column of the second extendable support means has a rest position of extension with respect to the second insert member where the front seat portion is horizontal.

13. An exercise bench as claimed in claim 10, wherein the support column of the second extendable support means is connected to the base by pivot means for folding the support column of the second extendable support means from an operative position to a rest position along side the base.

14. An exercise bench as claimed in claim 10, wherein the tilting means is an arc-shaped rocker arm detachably connected with one end adjacent the rear end of the rear seat portion and slidably receivable in the support 15. An exercise bench as claimed in claim 14, wherein the arc-shaped rocker arm is slidably receivable between a plurality of contoured guide rollers.

16. An exercise bench as claimed in claim 14, wherein adjustable stopping means are provided on the rocker arm for limiting the range of movement thereof.

* * * * *